US009327206B2

(12) United States Patent
Donohoe

(10) Patent No.: US 9,327,206 B2
(45) Date of Patent: May 3, 2016

(54) BUILDING TOY

(71) Applicant: Mark Donohoe, St. Louis, MO (US)
(72) Inventor: Mark Donohoe, St. Louis, MO (US)

( * ) Notice: Subject to any disclaimer, the term of this patent is extended or adjusted under 35 U.S.C. 154(b) by 0 days.

(21) Appl. No.: 14/620,964

(22) Filed: Feb. 12, 2015

(65) Prior Publication Data

US 2015/0314208 A1 Nov. 5, 2015

Related U.S. Application Data

(60) Provisional application No. 61/986,260, filed on Apr. 30, 2014.

(51) Int. Cl.
*A63H 33/08* (2006.01)

(52) U.S. Cl.
CPC ..... *A63H 33/08* (2013.01); *A63H 33/084* (2013.01)

(58) Field of Classification Search
USPC ..... 446/105, 106, 108, 110, 111, 124, 125; 52/233
See application file for complete search history.

(56) References Cited

U.S. PATENT DOCUMENTS 1,351,086 A * 8/1920 Wright ..... A63H 33/044 446/106
1,402,438 A * 1/1922 Nichols ..... A63H 33/044 405/273
2,012,160 A * 8/1935 Forbes ..... A63H 33/04 446/106
2,059,598 A * 11/1936 Paulson ..... A63H 33/04 446/106
2,104,742 A * 1/1938 Fleischer ..... A63H 33/06 446/106
2,712,199 A * 7/1955 Latimer ..... A63H 33/084 403/217
2,946,150 A * 7/1960 Houk ..... A63H 33/16 446/106
3,257,762 A * 6/1966 Steiner ..... E04B 2/702 446/106
4,270,304 A * 6/1981 Sofer ..... A63H 33/084 446/106
4,372,076 A * 2/1983 Beck ..... A63H 33/06 446/106
5,145,440 A * 9/1992 Boris ..... A63H 33/008 446/106
5,174,078 A * 12/1992 West ..... E04B 2/702 446/106
5,281,181 A * 1/1994 McCollum ..... A63H 33/044 446/106
5,354,223 A * 10/1994 Wawzonek ..... A63H 33/044 119/428
5,846,114 A * 12/1998 Frandsen, II ..... E04H 17/1404 446/106
6,059,630 A * 5/2000 Paxton ..... A63H 33/044 446/106
6,094,876 A * 8/2000 Ogo ..... E04B 2/702 446/106
6,146,232 A * 11/2000 Robbins ..... A63H 33/06 446/106
6,189,271 B1 * 2/2001 Christensen ..... E04B 2/702 446/106
D466,166 S 11/2002 George
6,923,705 B2 * 8/2005 DeSalvo ..... A63H 33/044 446/106
7,044,824 B2 * 5/2006 Chavez ..... A63H 33/044 446/106
8,105,127 B2 * 1/2012 Heston ..... A63H 33/044 446/106

* cited by examiner

*Primary Examiner* — Kurt Fernstrom
(74) *Attorney, Agent, or Firm* — Lewis Rice LLC

(57) ABSTRACT

A building toy and a method of building with it. The toy is designed to be constructed of a rigid and generally non-deformable material such as, but not limited to, wood and particularly hardwood, and is constructed in the fashion of a log-style building toy. The toy utilizes interconnecting notches in its construction, but provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built.

17 Claims, 14 Drawing Sheets

BUILDING TOY

CROSS REFERENCE TO RELATED APPLICATION(S)

This application claims benefit of U.S. Provisional Patent Application Ser. No. 61/986,260, filed Apr. 30, 2014, the entire disclosure of which is herein incorporated by reference.

BACKGROUND

1. Field of the Invention

This disclosure is related to a building toy. Specifically, it is directed to a log-style building toy comprising a plurality of interlocking rigid pieces.

2. Description of the Related Art

Building toys have always been very popular with children. The ability to construct structures and other items which can then be played with can provide for hours of entertainment. Further, building toys are often considered very educational. As opposed to simpler toys such as dolls, plush toys, or miniature cars where play is limited to using the toy in a fashion that comports with its real world counterpart, building toys can often be constructed into a near limitless array of items.

Today there are a wide variety of building toys on the market. The most well-known, and also most versatile, are brick toys such as the Lego™ Brick. This toy provides a huge array of different pieces and colors and has been used not just as a toy, but as a professional architecture, engineering, and robotics tool. However, it is merely one of many examples of toys which utilize the most modern manufacturing techniques and materials to make a toy with a huge number of uses.

One of the more venerable building toys are log-style building toys the most well-known of which is Lincoln Logs™ which are constructed of wood. While plastic pieces have, on occasion, been provided, Lincoln Logs™ which are designed for the building of toy log cabins and similar westward expansion themed buildings are now, and have for most of their existence, been made of wood. Log-style building toys are well established and in many respects a "classic" toy. Lincoln Logs™ have been inducted into the toy hall of fame and have been on sale for almost a century.

Log-style building toys provide for certain benefits over other types of building toys. Because they are commonly made of wood, they provide for a different, and often desirable, texture, heft, and structure compared to most other building toys which are made from plastic. This can be beneficial to expose children to different experiences and allow them to work with different materials. They also provide for much easier construction of certain types of period structures, and provide for a structure with resultant surface depths and transitions.

At the same time, wood is relatively limited in its connection ability. Most modern building toys which provide for interconnection between parts generally rely on the slight giveability and resilience of plastics to provide for a strong interconnection. Basically, these toys "snap" together by causing the plastic to slightly deform and reform as the pieces connect. This is a feature that wood generally does not have. Because of that, log-style building toys have traditionally had a very strong limitation in the types of things they can construct. Specifically, they can only interconnect by connecting one cut-out to another at right angles forcing them to make square structures. This arrangement is illustrated in U.S. Pat. No. 1,351,086, the entire disclosure of which is herein incorporated by reference, that indicates that structures are assembled by interconnecting corresponding notches of transversely laid logs.

The problem with this arrangement, it that it essentially allows only for interconnection at right angles and at corners. While the patent contemplates the use of very short logs to essentially "fill" in notches where there is no structural transverse piece, the construction is very limited. This can be frustrating to children where a set of log-style building toys can really only be used to build a relatively specific building or set of buildings, and those buildings often lack the desired features that a child wants (such as a window in a particular position). Most children expect building toys to have a wide degree of flexibility. Those that lack flexibility are often rapidly discarded.

Log-style building toys also have problems in that the structures they build necessarily have gaps that would not exist in an actual building of log construction and lack certain important components. Roofs are generally simply laid on and often collapse with just minimal play. Many structures formed of these building toys are relatively unstable, and collapse if played with as toy structures. Further, floors and interior details are generally very complicated or impossible to build. Instead, interior details are usually provided more in the form of doll house furniture as preconstructed elements.

While the lack of flexibility can be frustrating for children, it has also resulted in log-style building toys being of little use for adult entertainment. Many Older adults, particularly those with degenerative neurological diseases such as Alzheimer's disease, can be entertained, and interacted with, through play because it is such a fundamental human action. Further, many older adults are comforted by textures of toys that are more akin to what they grew up with, not more modern plastics. One would think, therefore, that log-style building toys would be a valuable toy for use with adults. However, the lack of flexibility of existing log-style building toys can often make it too simple of a toy for these types of adults who have no interest in building in accordance with a plan or picture, but wish to express themselves creatively.

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein among other things are a building toy and a method of building with it. The toy is designed to be constructed of a rigid and generally non-deformable material such as, but not limited to, wood and particularly hardwood, and is constructed in the fashion of a log-style building toy. The toy utilizes interconnecting notches in its construction, but provides for a variety of specialized pieces which allow for interconnection of parts where there is one notch but not another, as well as the ability to build roofs, floors, and specialty structures such as fireplaces through the use of specialized components. Further, the use of more strongly connecting components allows for stronger structures to be built.

Described herein, among other things, is a log-style building toy comprising: at least two basic logs, each of the basic logs being generally in the form of an elongated parallelepiped with two opposing ends and four sides giving it a width, height, and length; the basic log including at least four notches arranged therein, the four notches being arranged as two pairs of notches with each of the pairs of notches arranged toward the opposing ends, each of the notches in each pair of notches being arranged on opposing sides of the basic log; and at least one special log, the special log being generally in the form of an elongated parallelepiped with two opposing ends and four sides; the basic log including at least two notches arranged therein, the two notches being arranged as a pair with each of the notches in the pair being arranged on opposing sides of the special log; wherein, all of the notches in both the basic logs and the special log are configured to extend a depth of one quarter of the height of the basic log into the log into which they are formed; wherein, the special log has a height which is generally three-quarters (¾) the height of the basic log; and wherein the notches on different logs are designed to interlock with each other when the notches are aligned and the logs with the aligned notches are placed generally perpendicular to each other.

In an embodiment of the building toy, the building toy is constructed from hardwood.

In an embodiment of the building toy, the two basic logs are of different length.

In an embodiment, the building toy further comprises at least one additional basic log with a length different from the at least two basic logs.

In an embodiment, the building toy further comprising at least two gables and a plurality of roof slats having two opposing ends and four sides, each of the roof slats including a flange on one of the sides.

In an embodiment of the building toy, the flanges are positioned to extend from a major surface of the roof slat creating a co-planar surface with the major surface.

In an embodiment, the building toy, further comprises a gable support which slides into grooves on a first surface of each of the gables to inhibit two opposing gables from moving toward each other.

In an embodiment, the building toy further comprises at least four roof rafters and two band boards, where the roof rafters can be positioned as two opposing pairs on the band boards to form roof gables.

In an embodiment of the building toy, each of the band boards is of the same size and shape as the at least two basic logs, but includes only two notches on a single side thereof.

In an embodiment of the building toy, the band board includes an elongated channel running the length of a side opposing the single side with the notches therein.

In an embodiment of the building toy, the channel creates two opposing rails to either of which the roof rafters can attach via a groove in the roof rafters.

In an embodiment of the building toy, the channel extends to a second side of the band board to create a single rail to which the roof rafters can attach via a groove in the roof rafters.

In an embodiment, the building toy further comprises a floor support log generally in the form of an elongated parallelepiped with two opposing ends and four sides giving it a width, height, and length; the floor support log including at least four notches arranged therein, the four notches being arranged as two pairs of notches with each of the pairs of notches arranged toward the opposing ends, each of the notches in each pair of notches being arranged on opposing sides of the floor support log; and the floor support log including an elongated channel between both the ends arranged in a side which does not include any notches.

In an embodiment, the building toy further comprises: a chimney transition piece; and a chimney block connectable to the chimney transition piece.

In an embodiment of the building toy, both the chimney transition piece and the chimney block include holes.

In an embodiment, the building toy further comprises a dowel sized and shaped to fit into the holes, the dowel serving to connect the chimney block to the chimney transition piece.

In an embodiment, the building toy further comprises a bay window log, the bay window log having a large notch therein which is the length of two notches.

BRIEF DESCRIPTION OF THE DRAWINGS

FIG. 1A shows a basic log, FIG. 1B shows a half log, and FIG. 1C shows a special log.

DESCRIPTION OF THE PREFERRED EMBODIMENT(S)

Described herein a building toy which is intended for the construction of dwelling structures of the types commonly used by humans. The structure is designed to simulate the construction of log homes or similar structures which are constructed from long single pieces of wood as opposed to more modern constructions with wooden frames and slat siding and drywall covering. However, the resulting structure will generally have the appearance not of a true log home (which utilizes generally cylindrical logs in its construction) but of the more rectangular siding structure common in wood or vinyl sided structures. However, the exact appearance is by no means required.

Figure 1A:
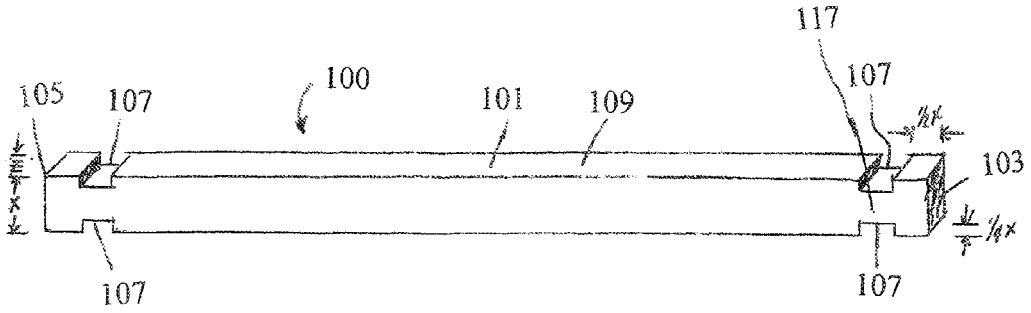
FIGS. 1A-1C show three basic log components of an embodiment of the building toy. Specifically.

The building toy is composed primarily of elongated parallelepipeds often with rounded corners to provide for better feel. However, generally cylindrical parts can be used in another embodiment. An embodiment of a general structure of the core building component of such a toy is shown in FIG. 1A. Many of the pieces of the toy will generally be referred to herein as "logs" due to their general shape and intended build methodology. Each log will generally be constructed of a relatively rigid and non-deformable material such as but not limited to wood (particularly hardwood), metal, rigid hard plastic, or stone. Non-deformable materials are preferred because the building toy is designed to utilize interlocking notches as the primary component of interconnection. Thus, the toy is not designed to have components deform in order to allow interconnection. Use of a rigid material is preferred not only because deformability is not necessary, but because such materials can provide the logs with greater heft and often a more interesting tactile experience.

FIG. 1A shows a basic log (100). Is comprised of an elongated body (101) of generally parallelepiped shape with four sides and two opposing ends (103) and (105). The shape will generally be defined by the elongate length, as well as a middle dimension height and smallest dimension width, however the relative sizes of the last two dimensions may be reversed in some embodiments. There will generally positioned toward each of the ends (103) and (105) a notch (107). In a basic log (100) there are two notches (107) positioned on opposing sides of the basic log (100) toward both ends (103) and (105). The notches will generally be on the two sides defining the dimension of height. A basic log (100) may also additionally or alternatively include any number of notches (107) within the center portion (109) between the notches (107) shown in FIG. 1A but that is not required as discussed later. Generally basic logs (100) will be provided in a variety of different lengths of the main body. These will often be multiples of lengths of other components so basic logs of 1, 2, 3, 4, 5, or more times the length of any other basic log (100) could be used.

The basic log (100) will also generally be provided in a "spacer" format which is designed to be shorter. A spacer format basic log (100) will generally only have a single notch (107) and the distance between the center of the notch (107) and the end (105) will be equal to the distance from the center of the notch (107) to the end (103). Generally a notch (107) in the basic log (100) will extend about one-quarter (¼) of the height of the enter portion (109) of the basic log (100). Thus, the height of the portion (117) of the basic log (100) between any two opposing notches (107) will generally be about one-half (½) the width of the center portion (109) of the basic log (100). Each notch (107) will generally have a length equal to the width of the log so that a log placed transverse to another with their notches align can be interlocked. The basic log (100) is the core building component of the toy.

Figure 1B:
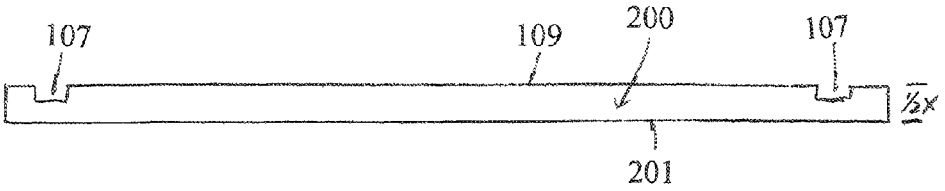

FIG. 1B provides an embodiment of a half log (200). The half log (200) is effectively the same arrangement as a basic log (100) which has been split in half along its length. It will generally only include notches (107) along a single side as shown in FIG. 1B. The half log (200) will generally be used to allow for a flat surface (201) to be provided so as to allow a construction of the toy to rest cleanly on a support structure.

Figure 1C:
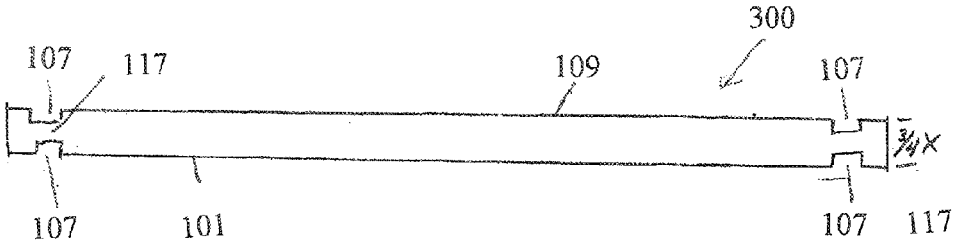

FIG. 1C provides for a special log (300). The special log (300) is designed to act as a part connector. In particular, it is designed to interconnect a notch (107) of any one log to the center portion (109) of another log. The special log (300) will generally be of the same design as the basic log (100), however it's dimensions are different. The special log (300) will have a main body (101) height which is only three quarters (¾) the height of a basic log (100), however, its width is the same as a basic log (100). As with all logs, its length is variable.

Figure 3:
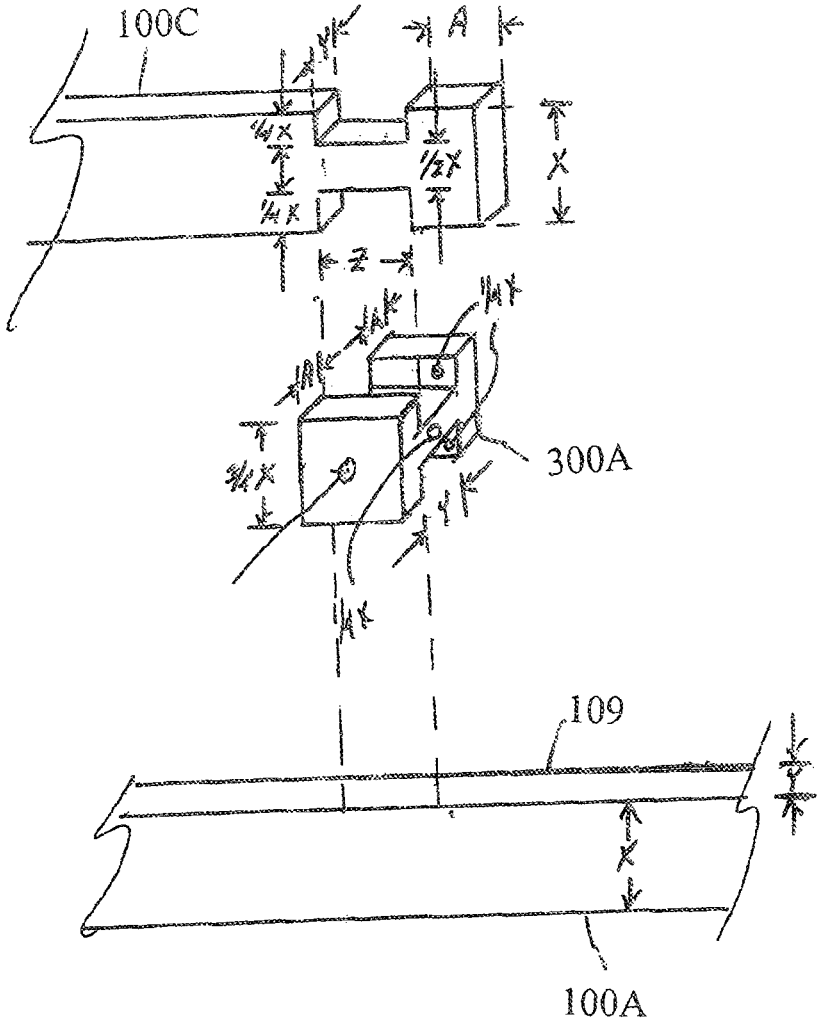
FIG. 3 shows how a specialty connector can be used to connect two logs together where there is only one notch present.

The notches (107) in the special log (300) are cut to the same dimensions as those of the basic log (100). Specifically, they are cut one quarter (¼) the height of the basic log (100) deep. This means the connector portion (117) is precisely one-quarter (¼) the height of the basic log (100) or one half (½) the height of the connector portion (117) of a basic log. While FIG. 1C shows a special log in the same arrangement as that of FIG. 1A, most of the special log (300) components of a toy set will generally be provided in the arrangement of a spacer log with only a single set of opposing notches (107). One such special log (300A) is shown in FIG. 3.

Figure 2:
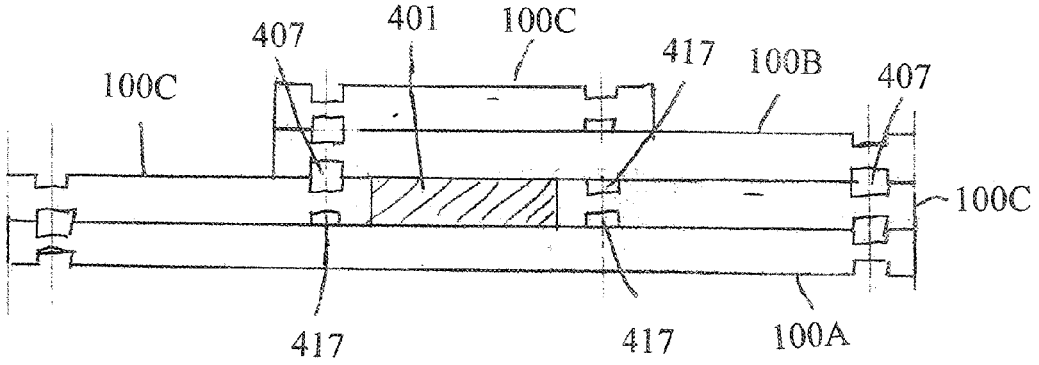
FIG. 2 shows an embodiment of the relative lengths of logs and how their notches will interlay when placed into a wall arrangement.

FIG. 2 shows how the various logs can be used to form a wall. As opposed to prior art building toys which required that logs always meet at notches (107), the present toy has no such requirement. In the arrangement of FIG. 2, three different lengths of basic log (100A), (100B) and (100C) which have no internal notches (107) in the center portions (109) have been arranged in the form of a wall which includes a void (401) which could be used as a window or similar architectural element. As can be seen from the FIG, at some points (407) two notches (107) are aligned while at other points (417) a notch (017) is against the central portion (109) of another log.

In the double notch points (407), a basic log (100) of desired size may be used as is common in prior art designs by simply aligning it's notches (107) with the double notch point (407) while transverse to the page of FIG. 2. However, placement of a basic log (100) in a single notch point (417) would produce an unstable attachment. However, the portion (117) of a special log (300) is correctly sized to fit here allowing a connection to be made as shown in FIG. 3. Due to the length of the notch (107) corresponding to the width of the log, the log (100A) can be placed within the notch (107) at its center section (109).

It should be noted that in positions where there is a double notch point (407) above or below a single notch point (417) (as is shown at the left internal notch stack in FIG. 2), because the special log (300) has only ¾ the total height of a basic log (100), the ends will touch forming a clean connection. The same is also true of two half notches above each other (as is shown in the right internal notch stack in FIG. 2) where the two special logs (300) will also touch creating a clean structure.

It should be apparent from the above that the inclusion of the special log (300) provides for vastly improved flexibility in construction as it eliminates the need for logs to always meet at notches. Thus, it is possible to make basic logs (100) of essentially any length, even if they are not multiples of each other. This allows for there to be a near limitless ability to create voids (401) of different shapes and sizes. As voids (401) are commonly used to represent windows and doors, these can now be positioned virtually anywhere in the walls, and need not be square as use of different lengths of basic logs (100) can create other shapes such as polygons which can appear rounded in certain situations.

While the above provides for vastly more flexibility to the basic log construction and many more options for use of the toy, with that flexibility it can also be desirable to have additional components which allow for the flexibility to carry into additional common components of man-made structures and dwellings.

Figure 4:
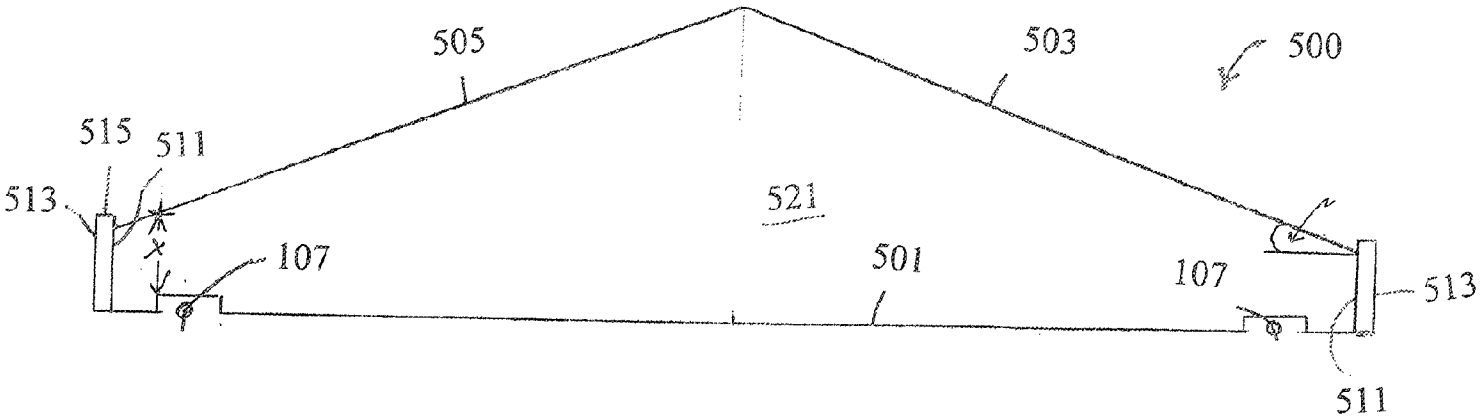
FIG. 4 shows an outside plan view of an embodiment of a fixed length roof gable.
Figure 6:
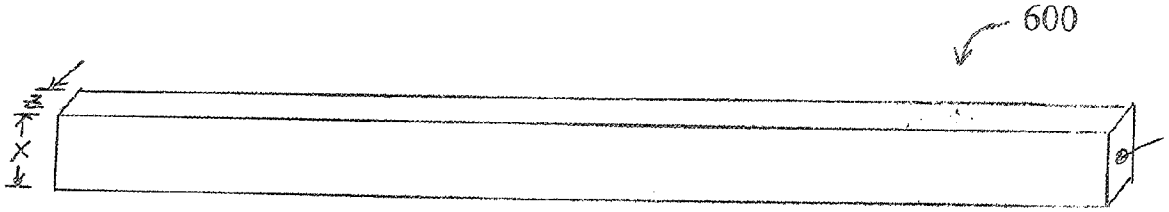
FIG. 6 shows an embodiment of a gable support.
Figure 5:
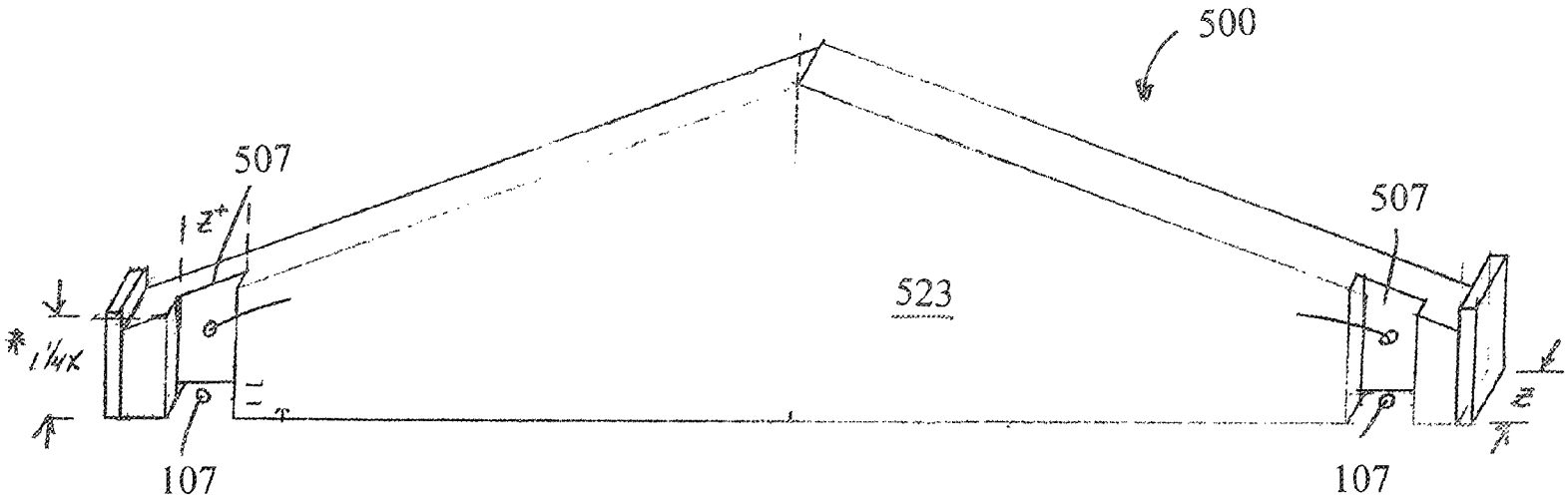
FIG. 5 shows an inside plan view of the gable of FIG. 4.

FIGS. 4 through 7 provide for various views of a fixed length and angle gable (500) for the formation of roofs for the toy structures. The gable (500) generally comprises a roughly triangular structure with blunted corners having a base (501) and two tops (503) and (505). While the gable (500) of the FIGS is an isosceles triangle, this is by no means required and other shapes can be used. Isosceles triangles, however, are commonly associated with the shapes of roofs making their design particularly appealing. Each gable will generally include two end notches (107) of the same depth as all the other previously discussed pieces on its bottom surface (501). However, as shown in FIG. 5, the gable (500) will also generally include a groove (507) aligned at 90 degrees to the notch (107). This groove (507) is generally of similar depth to the notch (107) and intersects it. The groove (507) serves as a point in which to slide a gable support (600).

Figure 7:
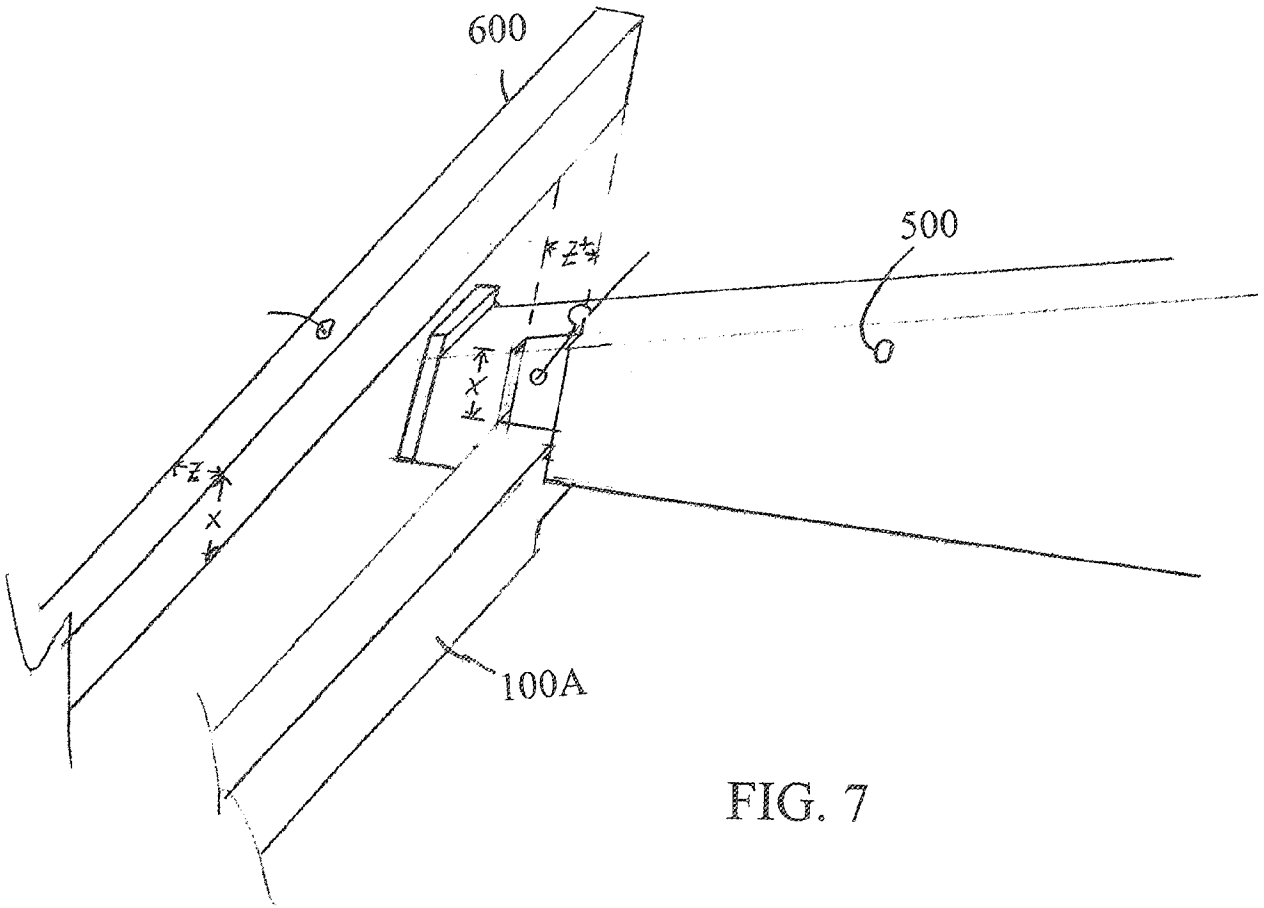
FIG. 7 shows the interconnection of a gable to a gable support to create a roof support.

The gable support (600) is shown in FIG. 5 and generally the same height and width dimensions as a basic log (100) from the set, but includes no notches, and has a length that is around the length of the basic log between the edges of the end notches (107) plus twice the depth of the groove (507). However, the length of the gable support (600) is highly variable and generally can be anything so long as the support interconnects to support the gables (500) such as is shown in FIG. 7. The gable support (600) is generally used to provide an internal surface which makes a wall smooth and continuous under the rafters.

FIG. 7 shows how one of the gables (500) would be connected to form a roof although two gables (500) opposingly positioned would generally be used. The gable (500) will generally be placed with the notch (107) of the gable (500) perpendicularly aligned with a notch (107) of generally a basic log (100A), although any log with a notch can be used. Once the notches (107) are positioned, the gable support (600) is dropped into the groove. It, therefore, supplies a surface resembling the rest of the wall, but it also serves to support the gable (500) upright. It should be apparent that with the notches (107) aligned between the gable (500) and basic log (100A), the outside surface (521) of the gable (500) is pushed against the inside of the basic log's (100A) notch (107). Further, the gable support (600) is against the inside surface of the groove (507).

If two gables (500) are now positioned opposing each other with their inside surfaces (523) facing and at a distance proportional to the selected gable support (600), the gables (500) effectively interlock with each other with the gable supports (600) on both sides, and the insides of the notches (107) of the basic log (100A) to form a fairly rigid structure to support the roof.

Figure 8:
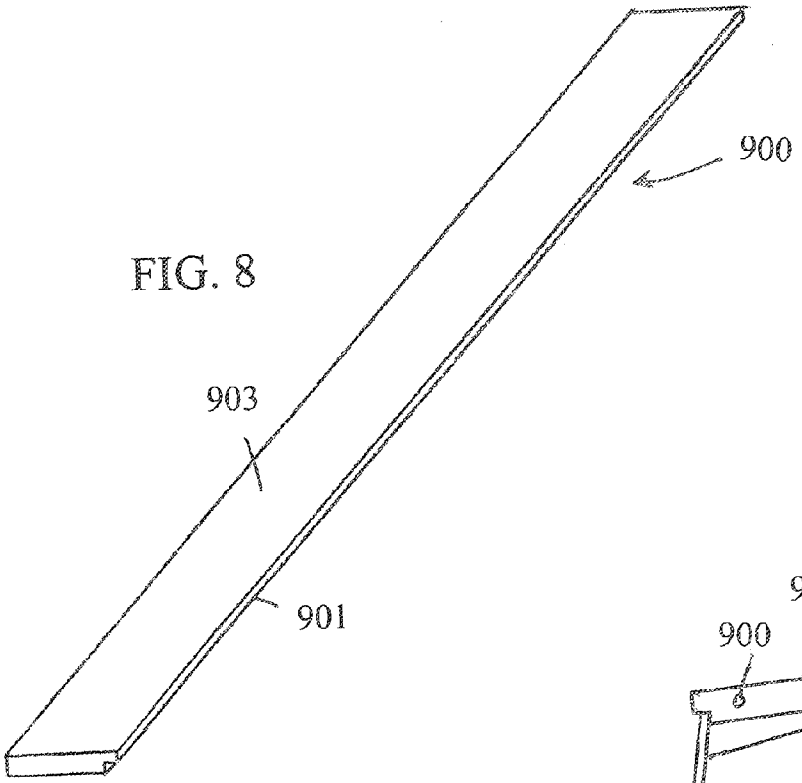
FIG. 8 shows an embodiment of a roof slat.
Figure 9:
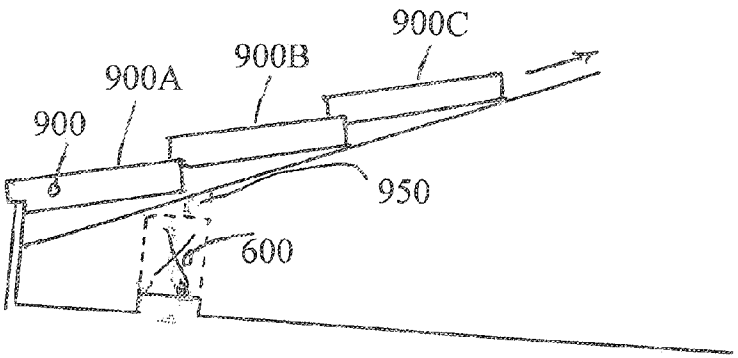
FIG. 9 shows an embodiment of roof slats arranged on the support of FIG. 8 or 14.

FIGS. 8 and 9 illustrate how a roof can be formed using two opposing gables (500). A plurality of roof slats (900) are generally provided with the toy. The roof slats (900) may be of any length, but as with all pieces will generally be of relatively common size based on relative proportions compared to the basic logs (100). Each roof slat (900) comprises a parallelepiped generally with one significantly smaller dimension. On one of the elongated narrow sides of the slat (900) there is a flange (901) which extends outwardly form the main body (903) of the slat. The flange will generally be about half the width (smallest dimension) of the roof slat and will be arranged to extend from one of the major surfaces to provide a co-planar surface with it.

As is visible in FIGS. 4 and 5, each of the gables (500) does not comprise a true triangle, but instead has the corners where each tops (503) and (505) intersect the base (501) cut off to form an end (511). At each end there is a support piece (513) which is generally aligned with the surfaces of the base (501) and each side (521) and (523). The support piece (513) is, however, generally is slightly taller than the end (511) resulting in their being a small extension (515) above the top (503) and (505).

To form a roof, the roof slats (900) are positioned on the top sides (503) and (505) of the gables as shown in FIG. 9. As can be seen from FIG. 9, each roof slat (900) is arranged so as to extend between the two gables. The lowest roof slat (900A) has its flange (901) resting on the top corner of the support piece (513) and therefore slightly raised above the top side (503) or (505) by a portion of the extension. Each consecutive roof slat (900B) and (900C) is positioned on the prior roof slat (900A) and (900B) respectively so that its flange (901) over hangs the back corner of the prior roof slat (900A) or (900B). This partial overlay provides for a more natural looking roof design, and also inhibits the roof slats (900) from sliding down the top surfaces (503) and (505).

It should also be apparent from FIG. 9 how the gable support (600) effectively blocks line of sight under the roof slats (900). With appropriate sizing, the gable support (600) will extend to a point either touching or just below the upward edge of the forward most roof slat (900A), and that point is generally vertically higher than the downward edge of the same slat. Thus, the gap (950), to the extent one exists, is generally hidden from sight by roof slat (900A).

While the gable (500) provides for a solid appearing roof with no obvious gaps and a sturdy construction method, the gable (500) is limited in that it has a large number of fixed dimensions. As the building toy is designed to have a large amount of variability in structure design, it is desirable in an embodiment to have a roof gabling system with increased flexibility compared to that shown in FIGS. 4-7. An embodiment of such a design is provided in FIGS. 10-13.

Figure 10:
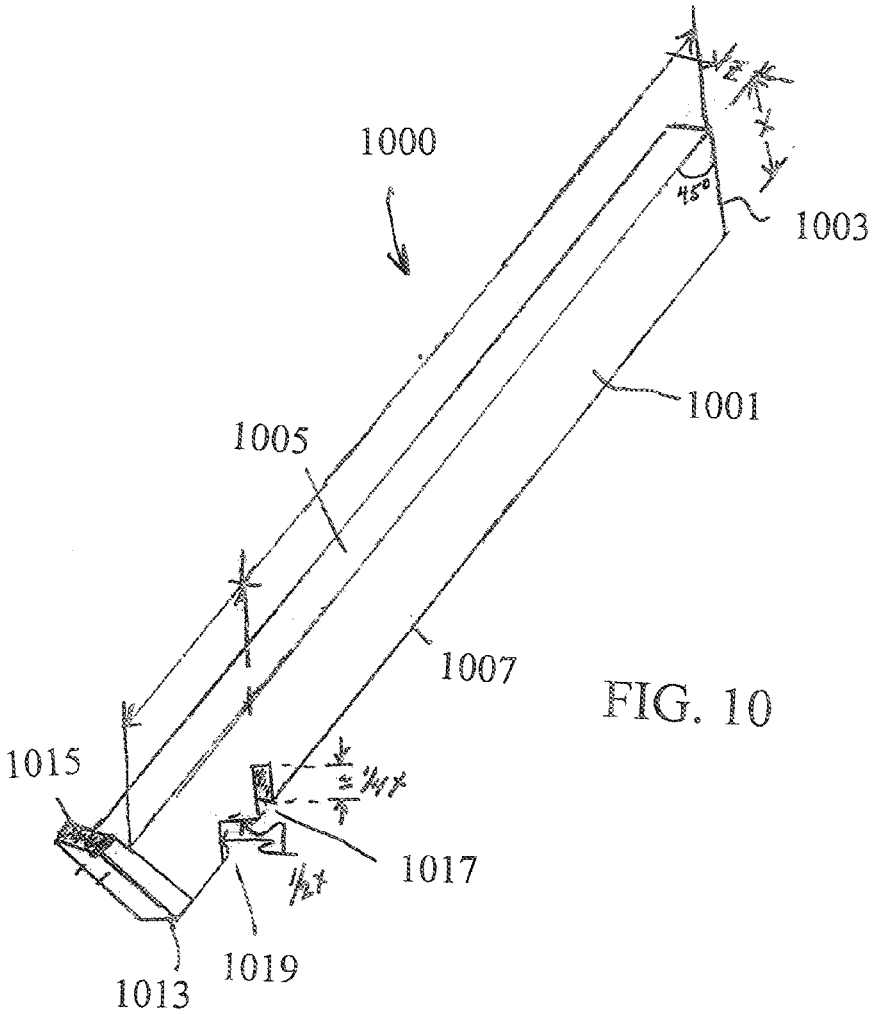
FIG. 10 shows an embodiment of a roof rafter.

FIG. 10 provides for an embodiment of a rafter (1000). The rafter (1000) comprises a generally parallelepiped main body (1001) where the first end (1003) is cut at an angle from the top to the bottom (e.g. the angle is relative to the height). At the second end (1005) there is included a support piece (1013) of design generally similar to support piece (513) of FIG. 4 and which provides an extension (1015) above the top surface (1005) of the rafter.

Figure 11:
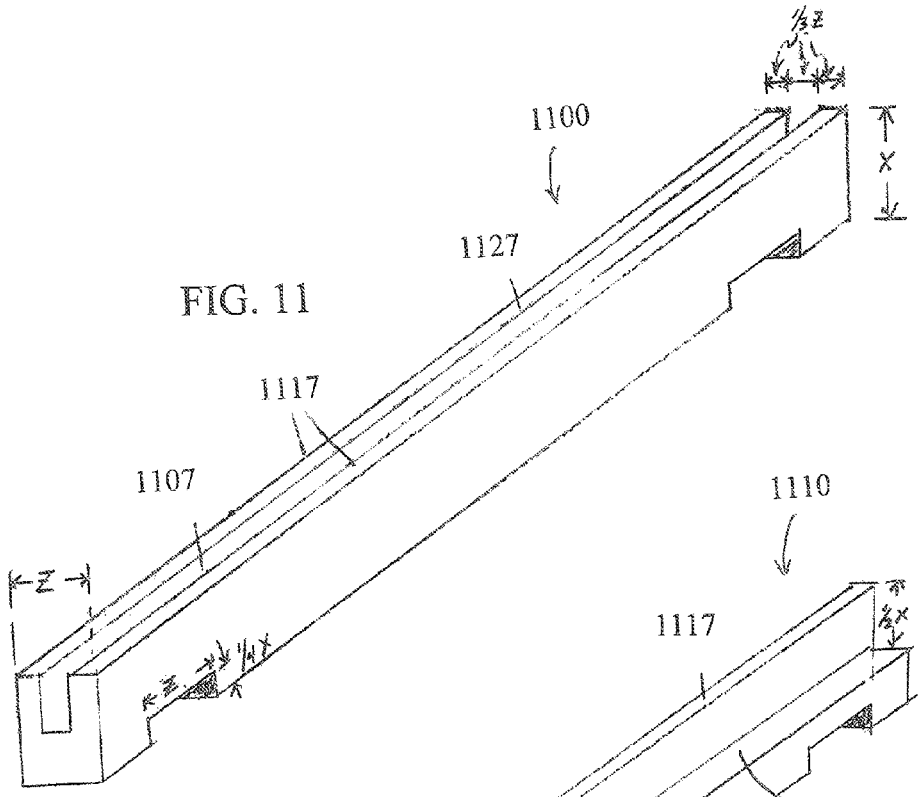
FIG. 11 shows an embodiment of a rafter support or band board.
Figure 12:
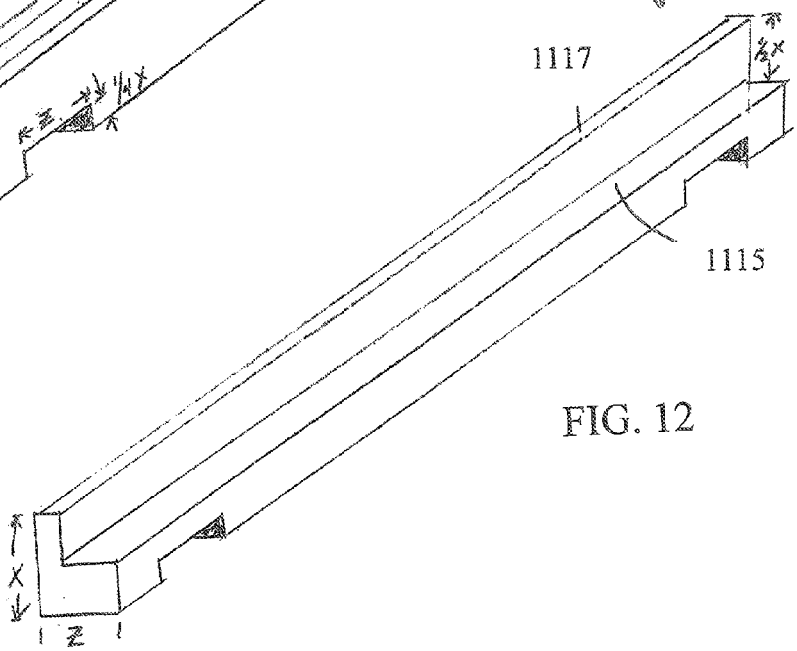
FIG. 12 shows an embodiment of a rafter support which can also support an "attic" floor.

On the bottom surface (1007) of the rafter (1000) there is provided a groove (1017) and a cutout (1019). The groove (1017) is designed to interface with one of the rails (1117) of a roof band board (1100) or (1110) as shown in FIGS. 11 and 12 and will generally be cut into the rafter (1000) at an angle corresponding to the angle the first end (1003) is cut to. As such, the groove (1017) is generally sized and shaped to hold a rail (1117) therein. The cut out (1019) is an optional component that is designed to allow for the rafter (1000) to clear the end (105) or (103) of a basic log (100) to which the band board (1100) or (1110) is attached if the rafter is placed directly above the notch (107) of the band board (1100) or (1110). This is illustrated in FIG. 13

As indicated above, FIGS. 11 and 12 provide for embodiments of band boards (1100) and (1110). The band board (1100) of FIG. 11 is considered a default design and is intended for the purpose of attaching a roof only. The band board (1100) is generally the same dimensions as a basic log (100) but includes notches (1017) on only one side (the bottom) thereof. The side opposing the notches (107) has a channel (1107) running therethrough, the entire length of the band board (1100) which creates two flanges or rails (1117) on the opposing sides thereof. Generally the channel (1107) and the rails (1117) are all of the same width (one third (⅓) that of the band board (1100)) and the channel has a depth of one half (½) the height of the band board (1100), but that is by no means required.

The band board (1110) of FIG. 12 is a slight modification of FIG. 11. The band board (1110) is designed to be used where there is to be construction of an attic floor. The band board (1110) of FIG. 12 is generally identical to the band board (1100) of FIG. 11, however one of the rails (1117) is removed so that the base of the channel (1107) smoothly transitions to the side of the band board (1110) in a floor support surface (1115). This give the band board (1110) a generally "L"-shaped cross sectional structure.

Figure 13:
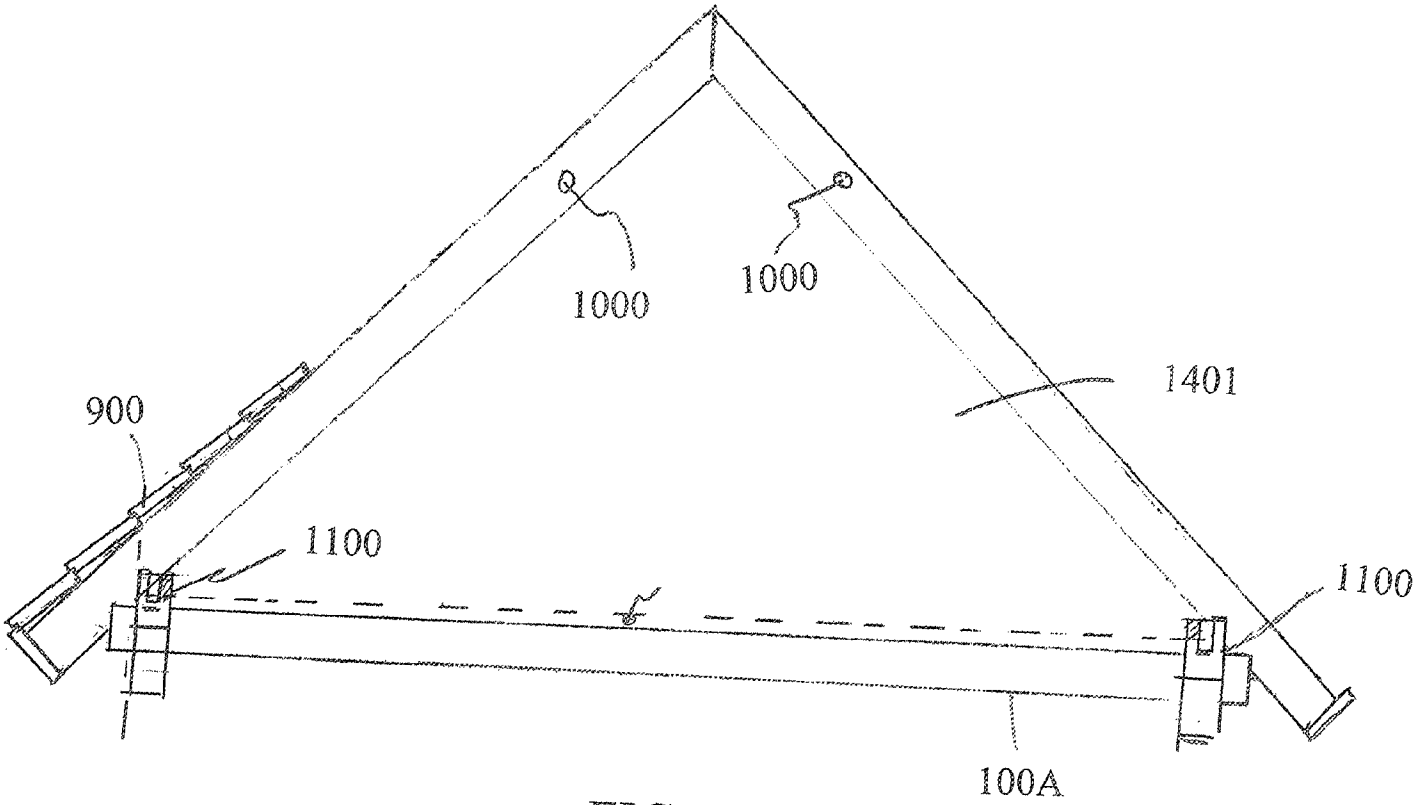
FIG. 13 shows a roof support assembled from the rafters of FIG. 10 and the rafter supports of FIG. 12 or 13.

FIG. 13 shows how to form a roof using the rafters and band boards of FIGS. 10-12. In FIG. 13, the band boards (1100) or (1110) are positioned transverse the highest basic logs (100) in the structure on two opposing sides. Four rafters (1000) are then used with two opposed length-wise at each side of the structure. The grooves (1017) are posited to hold the outermost rails (1117) of the two band boards (1100) or (1110). The angle ends (1003) of the two opposing rafters (1000) meet to form the roofline. Roof slats (900) are then positioned on the two sets of opposing rafter (1000) pairs in the same manner as when using gables (500).

If band boards (1110) are being used and a floor is desired, floor pieces may be positioned to rest on the floor support surfaces (1115) on the opposing sides. In an embodiment, the floor pieces may be large thin components. In another embodiment, floors are made by interlocking the flanges of two roof slats (900) with each other with a first slat (900) one way over and the other reverse. This forms a flat slab of generally double height. These "double-high" roof slat arrangements can then be arranged side by side to form a smooth floor. It should be noted that this arrangement of roof slats (900) can also be used to form flat roofs whether angled on a gable (500) or rafters (900) or simply across the top of a basic log (100) structure.

One advantage of using the roof band board (1100) in the roof support is that since its width is the same as a basic board, the upper surface (1127) formed of the tops of the two rails can be used to support two special logs (300) and a basic log (100) thereon at any position. This allows for the building of wall structure through the roof such as to build an interconnected tower, a specialized dormer window structure, a chimney, or a smokestack. In such a construction, additional sets of rafters (1000) may be used to make sure that all roof slats (900) are correctly supported on, at least, both their ends.

While not indicated in FIG. 13, the rafters (100) of FIG. 11 do produce an open sided roof. In some embodiments, this can be useful to allow access to the attic floor. In an alternative embodiment, the rafters (1000) may be modified to be in the shape of right triangles to fill in the gap (1401) or a fill piece may be provided which may interact with the rafters (1000) to fill the gap (1401). Alternatively a basic log (100) may be positioned on the uppermost surfaces of each of the upper most basic logs (100) of the structure (those which the band boards (1100) or (1110) are transverse to and internotched with) with special logs (300). Basic logs (100) of different lengths can then be used to fill the hole (1401) including making structures such as gable windows.

Figure 14:
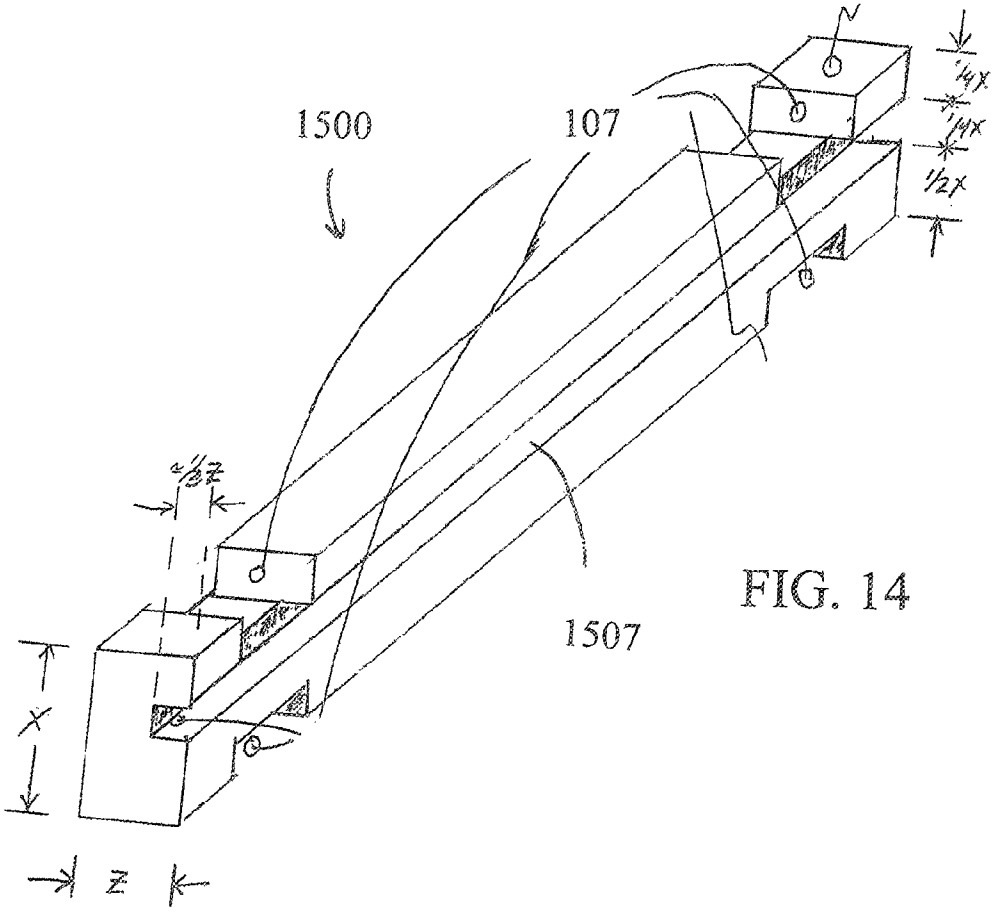
FIG. 14 shows a log for supporting a floor.
Figure 15:
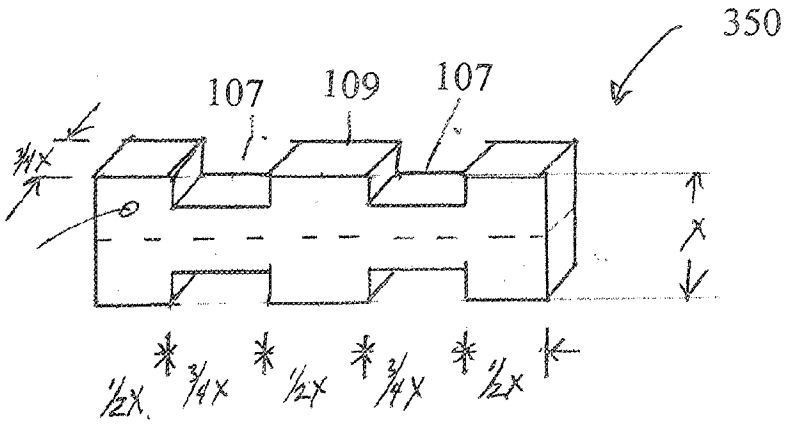
FIG. 15 shows a log for the construction of a chimney or other attached small structure.
Figure 16:
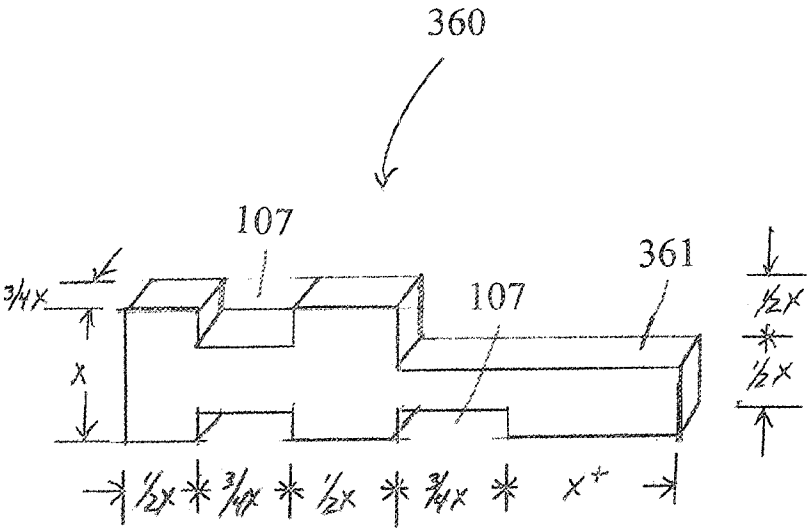
FIG. 16 shows a log for supporting a fireplace mantle.
Figure 17:
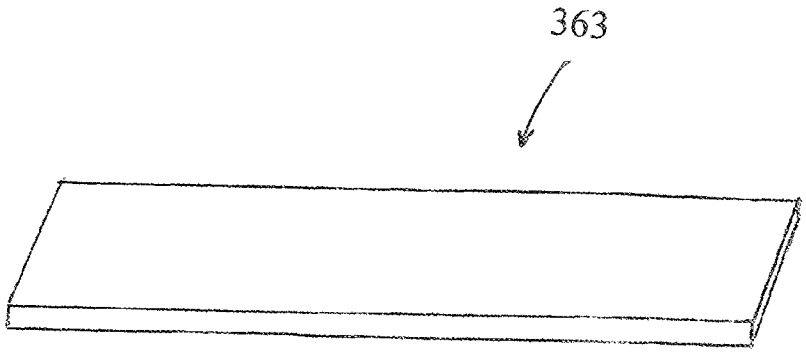
FIG. 17 shows an embodiment of a mantel piece.
Figure 18:
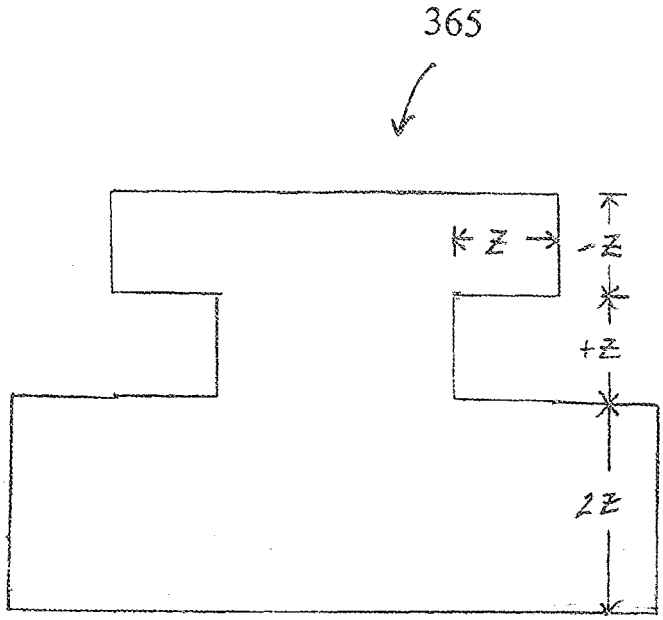
FIG. 18 shows an embodiment of a hearth piece.

FIG. 14 provides for a floor support log (1500). The floor support log (1500) is designed to allow for an internal floor to be provided to a structure. The floor support log (1500) is against generally sized and shaped to the same dimensions as at least one size of basic log (100). It also has notches (107) in the same generally position, and on opposing sides, as the basic log (100). The floor support log (1500), however, includes a channel (1507) on one of the non-notched sides (into its width). This channel (1507) is configured to hold floor panels of the type contemplated above, or the interlocked roof slats (900) as contemplated above to form a floor.

As the floor support log (1500) is essentially interchangeable with a basic log (100), it allows for a floor to be placed anywhere in a structure by simply providing two floor support logs (1500) at opposing positions with their channels (1507) both facing inward. It should also be apparent that while the channel (1507) is intended to support a floor internal to a structure, reversing the floor support log (1500) to place the channel (1507) external to the structure, allows a user to build an awning, deck, bridge, or similar structure.

FIGS. 15-18 provide for specialized parts that allow for the formation of a chimney structure. A chimney is effectively simply a very small extension from a wall. The chimney connector (350) is basically a specialized basic log (100) which includes two very closely positioned notch (107) pairs. The center portion (109) is generally sized so that is the same size as the end portions on each end after the notches (107). The chimney connector (350) therefore allows for small extension in a wall by placing two chimney connectors (350) at end notches (107) of two basic logs (100) each one third the length of the basic log forming the opposing wall (assuming a center chimney).

The top of the chimney on the interior is created with a mantel piece (360) which simply provides a mantel shelf (361) in place of one of the notches and cutting through one end. The mantle shelf (361) supports a specialized flat component which is the mantle (363). While it may not be needed in all structures, a chimney built on an upper floor can generate an undesirable hole in the floor. For this reason a specialized hearth (365) piece may be provided which fills the hole and provides the appearance of a hearth in the fireplace.

Figure 19:
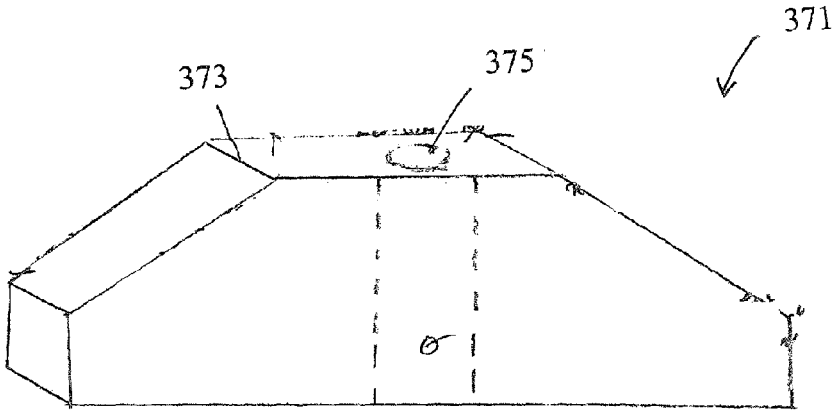
FIG. 19 shows an embodiment of a piece for transitioning a fireplace construction into a chimney.
Figure 20:
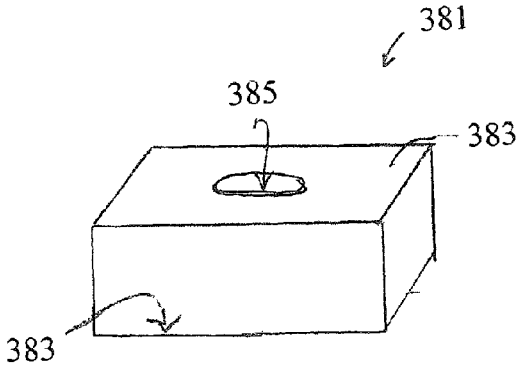
FIG. 20 shows an embodiment of a piece for forming a chimney.

FIGS. 19 and 20 provide for an embodiment of exterior chimney components. These would generally be placed external to the structure on the top of a chimney built using the chimney connector (350). However, in an alternative embodiment, they may be used to form an interior chimney as well (if the fireplace is internal). FIG. 19 provides for the chimney transition piece (371) which transitions form the fireplace to the flue. The transition (371) is generally roughly trapezoidal in shape with removed corners. In an embodiment, the angles of the angles sides are intended to correspond to the angles of a gable (500) to allow the transition to align with, or be part of, a roof. The top (373) of the transition (371) will generally include a center hole (375), which often does not penetrate all the way through the bottom surface, for supporting a cylindrical dowel rod or similar component.

Figure 21:
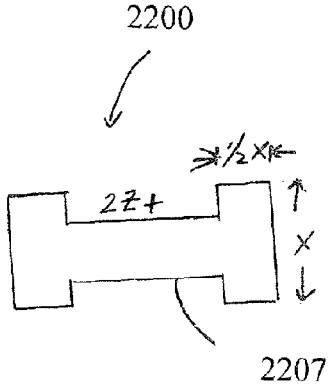
FIG. 21 shows an embodiment of a piece for making a bay window.

Chimney blocks (381) are shown in FIG. 21 and will generally also include a hole (385) however this hole (385) will generally run all the way through the chimney block (381) from both opposing sides. To construct the chimney, any number of chimney blocks (381) will be threaded onto a dowel rod placed in the hole (375) in the transition and moved down to rest on the top surface (373) of the transition (371). Generally, the chimney blocks will have major faces (383) with similar area to that of the top surface (373) so as to mesh smoothly in forming the chimney. A portion of the dowel rod may be left above the last threaded chimney block (381) to show a flue extension or stack, if desired.

FIG. 21 provides for one additional log which is a bay window log (2200). The bay window log (2200) allows for basic logs (100) to be placed side-to-side at their non-notched sides (double width). To accomplish this, the bay window log (2200) includes a long notch (2207). This long notch (2207) has the same length as two notches (107) and therefor allows for two basic logs (100), or any other logs, to be positioned side-by-side horizontally.

As should be apparent from the description above, the building toy discussed herein provides for a much greater variety of structures to be built with the inclusion of only a relatively small number of specialty parts. This provides for a log-style building toy with much more flexibility than has previously been available.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A log-style building toy comprising:

at least two basic logs, each of said basic logs being generally in the form of an elongated parallelepiped with two opposing ends and four sides giving it a width, height, and length; each of the basic logs including at least four notches arranged therein, said four notches being arranged as two pairs of notches with each of said pairs of notches arranged toward said opposing ends, each of the notches in each pair of notches being arranged on opposing sides of said basic log; and at least one special log, said special log being generally in the form of an elongated parallelepiped with two opposing ends and four sides; said special log including at least two notches arranged therein, said two notches being arranged as a pair with each of the notches in said pair being arranged on opposing sides of said special log;

wherein, all of said notches in both said basic logs and said special log are configured to extend a depth of one quarter of the height of the basic log into the log into which they are formed;

wherein, said special log has a height which is generally three-quarters (¾) the height of the basic log; and wherein said notches on different logs are designed to interlock with each other when said notches are aligned and said aligned notches are placed generally perpendicular to each other.

2. The building toy of claim 1 wherein said building toy is constructed from hardwood.

3. The building toy of claim 1 wherein said two basic logs are of different length.

4. The building toy of claim 3 further comprising at least one additional basic log with a length different from said at least two basic logs.

5. The building toy of claim 1 further comprising at least two gables and a plurality of roof slats having two opposing ends and four sides, each of said roof slats including a flange on one of said sides.

6. The building toy of claim 5 wherein said flanges are positioned to extend from a major surface of said roof slat creating a co-planar surface with said major surface.

7. The building toy of claim 5 further comprising a gable support which slides into grooves on a first surface of each of said gables to inhibit two opposing gables from moving toward each other.

8. The building toy of claim 1 further comprising at least four roof rafters and two band boards, where said roof rafters can be positioned as two opposing pairs on said band boards to form roof gables.

9. The building toy of claim 8 wherein each of said band boards is of the same size and shape as said at least two basic logs, but includes only two notches on a single side thereof.

10. The building toy of claim 9 wherein said band board comprises an elongated channel running the length of a side opposing said single side with said notches therein.

11. The building toy of claim 10 wherein said channel creates two opposing rails to either of which said roof rafters can attach via a groove in said roof rafters.

12. The building toy of claim 10 wherein said channel extends to a second side of said band board to create a single rail to which said roof rafters can attach via a groove in said roof rafters.

13. The building toy of claim 10 further including a floor support log generally in the form of an elongated parallelepiped with two opposing ends and four sides giving it a width, height, and length;

the floor support log including at least four notches arranged therein, said four notches being arranged as two pairs of notches with each of said pairs of notches arranged toward said opposing ends, each of the notches in each pair of notches being arranged on opposing sides of said floor support log; and the floor support log including an elongated channel between both said ends arranged in a side which does not include any notches.

14. The building toy of claim 1 further comprising:

a chimney transition piece; and a chimney block connectable to said chimney transition piece.

15. The building toy of claim 14 wherein both said chimney transition piece and said chimney block include holes.

16. The building toy of claim 15 further comprising a dowel sized and shaped to fit into said holes, said dowel serving to connect said chimney block to said chimney transition piece.

17. The building toy of claim 1 further comprising a bay window log, said bay window log having a large notch therein which is double the length of each notch in said basic log.

* * * * *